US005866287A

United States Patent [19]

Christian et al.

[11] Patent Number: 5,866,287

[45] Date of Patent: Feb. 2, 1999

[54] IMAGING ELEMENT COMPRISING AND ELECTRICALLY-CONDUCTIVE LAYER CONTAINING METAL ANTIMONATE AND NON-CONDUCTIVE METAL-CONTAINING COLLOIDAL PARTICLES

[75] Inventors: Paul A. Christian, Pittsford; Sharon M. Melpolder, Hilton; Dennis J. Eichorst, Fairport, all of N.Y.

[73] Assignee: Eastman Kodak Company, Rochester, N.Y.

[21] Appl. No.: 969,393

[22] Filed: Nov. 13, 1997

[51] Int. Cl.[6] ..... G03C 1/85; G03C 1/89

[52] U.S. Cl. ..... 430/63; 430/69; 430/527; 430/529; 430/530; 430/272.1

[58] Field of Search ..... 430/527, 529, 430/272.1, 63, 69, 530

[56] References Cited

U.S. PATENT DOCUMENTS

| | | | |
|---|---|---|---|
| 3,525,621 | 8/1970 | Miller | 430/527 |
| 4,203,769 | 5/1980 | Guestaux | 430/527 |
| 4,275,103 | 6/1981 | Tsubusaki et al. | 430/67 |
| 4,394,441 | 7/1983 | Kawaguchi et al. | 430/524 |
| 4,416,936 | 11/1983 | Erickson et al. | 428/286 |
| 4,416,963 | 11/1983 | Takimoto et al. | 430/69 |
| 4,418,141 | 11/1983 | Kawaguchi et al. | 430/530 |
| 4,431,764 | 2/1984 | Yoshizumi | 524/409 |
| 4,495,276 | 1/1985 | Takimoto et al. | 430/530 |
| 4,571,361 | 2/1986 | Kawaguchi et al. | 428/328 |
| 4,571,365 | 2/1986 | Ashlock et al. | 428/412 |
| 4,999,276 | 3/1991 | Kuwabara et al. | 430/527 |
| 5,006,451 | 4/1991 | Anderson et al. | 430/527 |
| 5,024,826 | 6/1991 | Linton | 423/335 |
| 5,028,580 | 7/1991 | Shimomura et al. | 503/207 |
| 5,122,445 | 6/1992 | Ishigaki | 430/530 |
| 5,204,219 | 4/1993 | Van Ooij et al. | 430/523 |
| 5,221,598 | 6/1993 | Anderson et al. | 430/527 |
| 5,236,737 | 8/1993 | Linton | 427/126.3 |
| 5,236,818 | 8/1993 | Carlson | 430/527 |
| 5,284,714 | 2/1994 | Anderson et al. | 430/527 |
| 5,294,525 | 3/1994 | Yamauchi et al. | 430/530 |
| 5,344,751 | 9/1994 | Carlson | 430/527 |
| 5,360,706 | 11/1994 | Anderson et al. | 430/530 |
| 5,366,855 | 11/1994 | Anderson et al. | 430/530 |
| 5,368,995 | 11/1994 | Christian et al. | 430/530 |
| 5,380,584 | 1/1995 | Anderson et al. | 430/324 |
| 5,382,494 | 1/1995 | Kudo et al. | 430/527 |
| 5,427,835 | 6/1995 | Morrison et al. | 430/527 |
| 5,439,785 | 8/1995 | Boston et al. | 430/530 |
| 5,459,021 | 10/1995 | Ito et al. | 430/527 |
| 5,545,250 | 8/1996 | Bergmann et al. | 75/252 |
| 5,576,163 | 11/1996 | Anderson et al. | 430/530 |
| 5,582,959 | 12/1996 | Ito | 430/527 |

FOREIGN PATENT DOCUMENTS

| | | |
|---|---|---|
| 0 250 154 | 12/1987 | European Pat. Off. . |
| 0 301 827 B1 | 7/1988 | European Pat. Off. . |
| 0 531 006 A1 | 3/1993 | European Pat. Off. . |
| 0 618 489 A1 | 10/1994 | European Pat. Off. . |
| 0 657 774 A1 | 6/1995 | European Pat. Off. . |

*Primary Examiner*—Richard L. Schilling
*Attorney, Agent, or Firm*—Carl F. Ruoff

[57] ABSTRACT

The present invention is a multilayer imaging element which includes a support, at least one image-forming layer, and a transparent electrically-conductive layer. The transparent electrically-conductive layer includes electronically-conductive metal antimonate colloidal particles having a particle size of from 0.005 to 0.05 μm and non-conductive metal-containing colloidal particles having a particle size of from 0.002 to 0.05 μm dispersed in a film-forming binder.

24 Claims, No Drawings

IMAGING ELEMENT COMPRISING AND ELECTRICALLY-CONDUCTIVE LAYER CONTAINING METAL ANTIMONATE AND NON-CONDUCTIVE METAL-CONTAINING COLLOIDAL PARTICLES

CROSS REFERENCE TO RELATED APPLICATIONS

This application relates to commonly assigned copending application Ser. No. 08/970,130 filed simultaneously herewith and hereby incorporated by reference for all that it discloses.

FIELD OF THE INVENTION

This invention relates generally to imaging elements and in particular, to imaging elements comprising a support, at least one image-forming layer, and at least one transparent, electrically-conductive layer. More specifically, this invention relates to electrically-conductive layers containing an intimate mixture of at least one type of an electrically-conductive metal antimonate particle and at least one type of a non-conductive, metal-containing filler particle both dispersed in a film-forming binder, which can provide protection for such imaging elements against the accumulation of electrostatic charge or serve as a transparent electrode in an image-forming process.

BACKGROUND OF THE INVENTION

Problems associated with the generation and discharge of electrostatic charge during the manufacture and use of photographic film and paper have been recognized for many years by the photographic industry. The accumulation of charge on film or paper surfaces can cause difficulties in support conveyance as well as lead to the attraction of dust, which can produce fog, desensitization, repellency spots during emulsion coating, and other physical defects. The discharge of accumulated static charge during or after the application of the sensitized emulsion layer(s) can produce irregular fog patterns or static marks in the emulsion. The severity of the static problems has been exacerbated greatly by increases in sensitivity of new emulsions, increases in coating machine speeds, and increases in post-coating drying efficiency. The charge generated during the coating process results primarily from the tendency of webs of high dielectric constant polymeric film base to undergo triboelectric charging during winding and unwinding operations, during conveyance through the coating machines, and during post-coating operations such as slitting, perforating, and spooling. Static charge can also be generated during the use of the finished photographic product. The repeated winding and unwinding of film in and out of a film cassette or cartridge can result in the generation of electrostatic charge, especially in a low relative humidity environment. The accumulation of charge on the film surface results in the attraction and adhesion of dust to the film and can even produce static marking. Similarly, high-speed automated film processing equipment can generate static that produces marking. Sheet films are especially subject to static charging during use in automated high-speed film cassette loaders (e.g., x-ray films, graphic arts films, microfiche, etc.).

An electrically-conductive layer can be incorporated into an imaging element in various ways to dissipate accumulated static charge, for example, as a subbing layer, an intermediate layer or interlayer, and especially as an outermost layer either overlying the imaging layer or as a backing layer on the opposite side of the support from the imaging layer(s). A wide variety of conductive antistatic agents can be used in antistatic layers to produce a broad range of surface electrical conductivities. Many of the traditional antistatic layers used in imaging elements employ electrically-conductive materials which exhibit predominantly ionic conductivity, for example, simple inorganic salts, alkali metal salts of surfactants, alkali metal ion-stabilized colloidal metal oxide sols, ionic conductive polymers or polymeric electrolytes containing alkali metal salts and the like. The electrical conductivities of such ionic conductors are typically strongly dependent on the temperature and relative humidity of their environment. At low relative humidities and temperatures, the diffusional mobilities of the charge-carrying ions are greatly reduced and the bulk electrical conductivity is substantially decreased. At high relative humidities, an unprotected ionic antistatic backing layer containing such an ionic conductor can absorb water, swell, and soften. Especially in the case of photographic roll films, this can result in the adhesion (viz., ferrotyping) and even physical transfer of portions of a backing layer to a surface layer on the emulsion side of the film (viz., blocking).

Antistatic layers containing electronic conductors such as conjugated conductive polymers, conductive carbon particles or fibers, metallic particles or fibers, crystalline semiconductor particles, amorphous semiconductive fibrils, and continuous semiconductive thin films can be used more effectively than ionic conductors to dissipate static charge since their electrical conductivity is independent of relative humidity and only slightly influenced by ambient temperature. Of the various types of electronic conductors, electrically-conductive metal-containing particles, such as semiconductive metal oxides, when dispersed with suitable polymeric film-forming binders, are particularly effective for use in transparent conductive layers. Binary metal oxides doped with appropriate donor heteroatoms or containing oxygen deficiencies have been disclosed in prior art to be useful in antistatic layers for photographic elements, for example: U.S. Pat. Nos. 4,275,103; 4,416,963; 4,495,276; 4,394,441; 4,418,141; 4,431,764; 4,495,276; 4,571,361; 4,999,276; 5,122,445; 5,294,525; 5,382,494; 5,459,021; and others. Suitable claimed conductive metal oxides include: zinc oxide, titania, tin oxide, alumina, indium oxide, silica, magnesia, zirconia, barium oxide, molybdenum trioxide, tungsten trioxide, and vanadium pentoxide. Preferred doped conductive metal oxide granular particles include Sb-doped tin oxide, Al-doped zinc oxide, and Nb-doped titanic Additional preferred conductive ternary metal oxides disclosed in U.S. Pat. No. 5,368,995 include zinc antimonate and indium antimonate. Other suitable conductive metal-containing granular particles including metal borides, carbides, nitrides, and suicides have been disclosed in Japanese Kokai No. JP 04-055,492.

Antistatic backing or subbing layers containing colloidal amorphous vanadium pentoxide, especially silver-doped vanadium pentoxide, are described in U.S. Pat. Nos. 4,203,769 and 5,439,785. Colloidal vanadium pentoxide is composed of highly entangled microscopic fibrils or ribbons 0.005–0.01 $\mu$m wide, about 0.001 $\mu$m thick, and 0.1–1 $\mu$m in length. However, colloidal vanadium pentoxide is soluble at the high pH typical of developer solutions for photographic processing and must be protected by a nonpermeable, barrier layer as taught in U.S. Pat. Nos. 5,006,451; 5,221,598; 5,284,714; and 5,366,855, for example. Alternatively, a film-forming sulfopolyester latex or polyesterionomer binder can be combined with the colloidal vanadium pentoxide in the conductive layer to minimize degradation during processing as taught in U.S. Pat. Nos. 5,360,706; 5,380,584; 5,427,835; 5,576,163; and others. While the use of a polyesterionomer binder provides improved coating solution stability and enhanced interlayer adhesion, a hydrophobic overcoat still must be provided in order to ensure the degree of process-surviving capabilities desirable for photographic imaging elements. The need to overcoat the antistatic layer with such a hydrophobic barrier layer has several potential disadvantages including increased manufacturing cost and complexity; inability to use the antistatic layer as the outermost layer; and limited ability to overcoat the antistatic layer directly with a hydrophilic, water swellable layer such as a curl control layer or pelloid. Thus, it is desirable to avoid the use of a hydrophobic barrier layer overlying an antistatic layer in a photographic element.

The use of non-conductive "auxilliary" fine particles such as binary metal oxides (e.g., ZnO, $TiO_2$, $SiO_2$, $Al_2O_3$, MgO, BaO, $WO_3$, $MoO_3$, $ZrO_2$, $P_2O_5$), kaolin, talc, mica, alkaline earth sulfates (e.g., $BaSO_4$, $SrSO_4$, $CaSO_4$, $MgSO_4$) or alkaline earth carbonates (e.g., $CaCO_3$, $MgCO_3$) as grinding aids in the preparation of electrically-conductive layers containing conductive metal oxide particles for use in photographic elements has been disclosed in U.S. Pat. Nos. 4,416,963; 4,495,276; 5,028,580, and 5,582,959. It was claimed in the '580 Patent that "fine grains" of a crystalline non-conductive metal oxide which do not contribute directly to improving conductivity can be added to a backing layer for a thermal recording imaging element. It was further disclosed in the '580 patent that it was particularly advantageous to remove a greater part of any such auxilliary particles by physical (e.g., filtration, centrifugation, etc.) or chemical (e.g., dissolution) treatments after preparing dispersions of the conductive metal oxide particles and before preparing coated layers.

Colloidal silica in the form of an aqueous sol consisting of silica particles with a high specific surface area can be used in combination with a soluble alkylaryl polyether sulphonate to provide conductive backing layers for photographic paper as disclosed in U.S. Pat. No. 3,525,621. However, such conductive layers exhibit unsuitably low levels of conductivity after photographic processing because of the solubility of the alkylaryl polyether sulphonate in the photographic processing solutions.

The use of colloidal non-conductive metal oxide particles combined with an optional film-forming polymeric binder to prepare conductive layers for photographic elements has been taught widely in prior art. For example, the preparation of conductive layers comprising a continuous gelled network of colloidal metal oxide particles on a photographic film or paper support is taught in European Application Nos. 250,154; 301,827; 531,006; 657,774. Preferred colloidal particles are disclosed to have an average diameter less than about 20 nm. The inclusion of an ambifunctional silane compound as a coupling agent in conductive layers containing colloidal metal oxide particles to improve adhesion to overlying gelatin-containing layers was claimed in U.S. Pat. No. 5,204,219. Preferred colloidal metal oxide particles claimed include silica, titania, and tin oxide, and mixtures thereof. Dispersions of such colloidal metal oxide particles are typically stabilized electrostatically by the presence of alkali metal or ammonium cations. The use of gelatin or a gelatin-compatible protein such as chitosan (i.e., a d-glucosamine) as a film-forming polymeric binder is taught in European Application Nos. 657,774 and 531,006, respectively. Coatings prepared in accordance with European Application No. 531,006 contain colloidal metal oxide particles at a particle to polymeric binder weight ratio of from 75:25 to 92:8 and exhibit surface resistivity values of 8–10 log ohms/square at 40% R.H. which increased to 10–11 log ohms/square after photographic processing. The addition of a water soluble alkali metal orthosilicate or metasilicate to a conductive layer containing a gelled network of colloidal metal oxide particles in order to improve cohesion as well as adhesion of the layer when overcoated with a gelatin-containing layer is taught in U.S. Pat. Nos. 5,236,818 and 5,344,751 and European Application No. 657,774.

The use of colloidal metal oxides in the presence of alkali metal ions, multifunctional silanes, and various ionic conductive polymers such as sodium styrenesulfonate/maleic acid copolymers in antistatic layers for photographic elements is disclosed in European Application No. 618,489. Preferred colloidal metal oxides include titania, silica, and alumina. Antistatic coatings were reported to exhibit surface resistivity values ranging from 6 to 10 log ohms/square. However, no values were reported for the antistatic coatings after photographic processing. The use of colloidal metal oxide particles in combination with various organosilanes in transparent abrasion-resistant protective topcoatings for polymeric sheets or articles is disclosed in U.S. Pat. No. 4,571,365. The use of non-conductive colloidal metal oxides (e.g., alumina, antimony oxide) as well as conductive metal oxides (e.g., antimony-doped tin oxide, tin doped indium oxide, cadmium stannate) in such coatings was claimed. Use of conductive metal oxides was reported to improve static dissipating properties of the protective layers. However, the utility of such protective layers for imaging elements was neither disclosed nor anticipated.

A class of composite, electrically-conductive powders said to be useful for preparing conductive coatings, films, and other articles consisting of an intimate mixture of at least one type of electrically-conductive powder and at least one type of a particulate filler material which is nonconductive has been disclosed in U.S. Pat. No. 5,545,250. Such composite conductive powders preferably contain binary or ternary mixtures of the component powders. Further, the composite conductive powders are said to exhibit dry powder resistivity values which are lower than the weighted average of the dry powder resistivity values for the component powders. Suitable electrically-conductive component powders include crystalline antimony-doped tin oxide particles as well as composite conductive particles consisting of non-conductive core particles such as oxides of titanium, silicon, magnesium, calcium, barium strontium, zinc, tin, nickel or iron; carbonates or sulfates of calcium, barium or strontium; mica, cordierite, anorthite, pyrophyllite, and the like, upon which an amorphous silica coating and a network of conductive crystallites (e.g., antimony-doped tin oxide, silver, gold, copper, nickel, etc.) are deposited sequentially. Specific methods for preparing such composite conductive particles have been described in detail in U.S. Pat. Nos. 5,024,826 and 5,236,737. Suitable non-conductive filler powders include amorphous silica, hollow silica shells, titania, mica, calcium carbonate, as well as the core particles used to prepare the composite conductive particles described hereinabove. The method used to prepare the composite electrically-conductive powders of the '250 Patent is described as essentially a relatively gentle dry blending procedure that is sufficient to provide intimate mixing of the individual component powders without degrading the electroconductive properties of the conductive component powders. Further, conductive coatings prepared using dispersions of composite conductive powders of the type taught in the '250 Patent having a film-forming binder in an aqueous vehicle are said to exhibit less color and higher optical transparency than such coatings containing equivalent amounts of the electrically-conductive component powders. However, the particles comprising the composite conductive powders as well as the conductive and non-conductive component particles taught in the '250 Patent are substantially too large to provide conductive layers with optical transparency and low haze properties suitable for use in photographic or thermally-processable imaging elements.

The use of colloidal, electrically-conductive metal antimonate particles (e.g., zinc antimonate particles) in antistatic layers for imaging elements, especially for silver halide-based photographic elements, is broadly claimed in U.S. Pat. No. 5,368,995. However, dry weight coverages of zinc antimonate in conductive subbing and backing layers sufficient to provide preferred levels of electrical conductivity for antistatic protection of imaging elements, especially in the case of micrographic films and other films, which are sensitized primarily to blue light, produce an undesirable increase in optical density and haze. The requirements for low optical density, low haze, lack of photoactivity, and low manufacturing cost dictate that the conductive layer must be coated using as low a dry weight coverage of metal antimonate as possible. One objective of the present invention is to provide transparent, conductive layers which deliver adequate antistatic protection as well as exhibit lower optical absorption and scattering losses than conductive layers containing metal antimonate of prior art. It is a further objective of the present invention to maintain the required physical properties of the conductive layers such as adhesion to overlying or underlying layers when used as a subbing layer, an interlayer or a protective layer, cohesion of the conductive layer in order to minimize dusting, and scratch and abrasion resistance when the conductive layer is to be used as an outermost protective layer such as a backing or overcoat layer. Because the requirements for a conductive layer to be useful in an imaging element are extremely demanding, the art has long sought to develop improved conductive layers exhibiting a suitable balance of all the necessary chemical, physical, optical, and electrical properties.

SUMMARY OF THE INVENTION

The present invention is a multilayer imaging element which includes a support, at least one image-forming layer, and a transparent electrically-conductive layer. The transparent electrically-conductive layer includes electronically-conductive metal antimonate colloidal particles having a particle size of from 0.005 to 0.05 μm and non-conductive metal-containing colloidal particles having a particle size of from 0.002 to 0.05 μm dispersed in a film-forming binder.

DETAILED DESCRIPTION OF THE INVENTION

This invention provides an improved imaging element for use in an image-forming process which includes a support, one or more image-forming layers, and one or more transparent, electrically-conductive layers, wherein the electrically-conductive layer contains both colloidal particles of an electroconductive metal antimonate compound having a rutile or rutile-related crystal structure and colloidal, non-conductive, metal-containing filler particles of comparable or smaller particle size, one or more film-forming polymeric binders, and other optional additives. Imaging elements in accordance with this invention can be of many different types depending on the particular use for which they are intended. Such elements can include, for example, photographic, thermographic, electrothermographic, photothermographic, dielectric recording, dye migration, dye-ablation, thermal dye transfer, electrostatographic, electrophotographic, thermally-processable imaging elements, and others. Detailed descriptions of the structure and function of each of these imaging elements are provided in U.S. Pat. No. 5,368,995 assigned to the same assignee as the present Application and incorporated herein by reference. The present invention can be practiced effectively in conjunction with any of the imaging elements described therein as well as others known to those skilled in imaging art.

A wide variety of non-conductive, metal-containing filler particles can be substituted for the conductive metal antimonate particles. Suitable non-conductive, metal-containing filler particles can include inorganic materials such as metal oxides, clays, proto-clays, clay-like minerals, zeolites, micas, and the like. Particularly suitable non-conductive filler particles include colloidal size (e.g., ~0.002–0.050 μm) particles of non-conductive tin oxide, zinc oxide, antimony pentoxide, zinc antimonate, silica, surface-modified silicas, various natural clays, synthetic clays, and the like. Non-conductive filler particles can be substituted for up to about 75% of the metal antimonate particles in a conductive layer without any appreciable decrease (i.e., ≦1 log ohm/square) in the surface electrical conductivity and with improved transparency and less haze than conductive layers with similar conductivity containing unsubstituted metal antimonate.

Conductive layers in accordance with this invention are broadly applicable to photographic, electrophotographic, thermographic, photothermographic, electrothermographic, electrostatographic, dielectric recording, dye migration, dye ablation, thermal-dye-transfer imaging elements, as well as other thermally-processable imaging elements, and are particularly useful for solution-processed silver halide imaging elements. Conductive layers of this invention may be present as backing, subbing, intermediate or protective overcoat layers on either or both sides of the support. Such layers are strongly adherent to the support and other underlying layers as well as to overlying layers such as pelloid, abrasion-resistant, transport control or imaging layers. Further, the electrical conductivity afforded by the conductive layers of this invention is nearly independent of relative humidity, only slightly degraded when overcoated with a gelatin-containing pelloid or sensitized emulsion layer and persists nearly unchanged after photographic processing. Thus, it is not necessary to provide a protective hydrophobic overcoat overlying the conductive layer of this invention, although optional protective layers may be present in the imaging element.

Photographic elements which can be provided with an electrically-conductive layer in accordance with this invention can differ widely in structure and composition. For example, they can vary greatly with regard to the type of support, the number and composition of image-forming layers, and the number and types of auxiliary layers included in the elements. In particular, photographic elements can be still films, motion picture films, x-ray films, graphic arts films, paper prints or microfiche films, especially CRT-exposed autoreversal and computer output microfiche (COM) films. They also can be black-and-white elements, color elements adapted for use in a negative-positive process or color elements adapted for use in a reversal process.

More particularly, the present invention relates to a photographic or a thermally-processable imaging element consisting of a support, at least one light- or heat-sensitive imaging layer, and at least one electrically-conductive layer. The electrically-conductive layer of this invention can be a subbing layer underlying a sensitized silver halide emulsion layer(s); an intermediate layer inserted between emulsion layers; an intermediate layer either overlying or underlying a pelloid in a multi-element curl control layer; an auxiliary layer or an outermost protective layer on either side of the support, in particular, a backing layer on the side of the support opposite to the emulsion layer(s) or a protective overcoat (topcoat) overlying the emulsion layer(s) or overlying an intermediate layer overlying the emulsion layer(s). In the case of thermally-processable imaging elements, the electrically-conductive layer can be a subbing layer underlying the imaging layer(s), a protective overcoat layer overlying an imaging layer, a backing layer or an intermediate layer either overlying or underlying a pelloid in a multi-element curl control layer.

The use of electrically-conductive metal antimonate colloidal particles in conductive layers for imaging elements and especially in antistatic layers for silver halide-based photographic elements is broadly claimed in U.S. Pat. No. 5,368,995. Metal antimonate compounds which are preferred for use in electrically-conductive layers in accordance with this invention have rutile or rutile-related crystallographic structures and stoichiometries represented by either Formula (I) or Formula (II) below:

(I) $M^{+2}Sb^{+5}{}_2O_6$ where $M^{+2}$=$Zn^{+2}$, $Ni^{+2}$, $Mg^{+2}$, $Fe^{+2}$, $Cu^{+2}$, $Mn^{+2}$, $Co^{+2}$ (II) $M^{+3}Sb^{+5}O_4$ where $M^{+3}$=$In^{+3}$, $Al^{+3}$, $Sc^{+3}$, $Cr^{+3}$, $Fe^{+3}$, $Ga^{+3}$ Several types of conductive metal antimonates (e.g., $M^{+2}$=$Zn^{+2}$; $M^{+3}$=$In^{+3}$) are commercially available from Nissan Chemical Industries, Ltd. in the form of an aqueous or organic solvent-based colloidal dispersion. Such materials can be prepared by the methods described in Japanese Kokai No. 06-219743. Alternatively, a method for preparing Formula (I) ($M^{+2}$=$Zn^{+2}$, $Ni^{+2}$, $Cu^{+2}$, $Fe^{+2}$, etc.) is taught in U.S. Pat. Nos. 4,169,104 and 4,110,247 wherein an aqueous solution of potassium antimonate (i.e., $KSb(OH)_6$) is treated with an aqueous solution of an appropriate soluble $M^{+2}$ metal salt (e.g., chloride, nitrate, sulfate, etc.) to form a gelatinous precipitate of the corresponding insoluble hydrate of Formula (I). These hydrated gels are isolated and then washed with water to remove excess potassium ions and salt anions. The washed gels can be peptized by treatment with an aqueous solution of organic base (e.g., triethanolamine, monoethanolamine, tripropanolaminediethanolamine, quaternary ammonium hydroxides, etc.) at temperatures of 25° to 150° C. as taught in U.S. Pat. No. 4,589,997 for the preparation of colloidal antimony pentoxide sols. Additional methods used to prepare colloidal sols of metal antimony oxide compounds have been reported. A sol-gel process has been described by Westin and Nygren (J. Mater. Sci., 27, 1617–25(1992); J. Mater. Chem., 3, 367–71(1993)) in which precursors of Formula (I) such as binary alkoxide complexes of antimony and a bivalent metal are hydrolyzed to give amorphous gels of agglomerated colloidal particles of hydrated Formula (I). Heat treatment of the hydrated gels at moderate temperatures (<800° C.) are reported to form anhydrous particles of Formula (I) of the same size as the colloidal particles in the gels. Further, colloidal particles of Formula (I) prepared by the methods described hereinabove can be made semiconductive through appropriate thermal treatment in a reducing or inert atmosphere. The preferred primary particle size for the metal antimonate particles is about 0.005 to 0.050 μm and more preferred, 0.010 to 0.030 μm.

In one preferred embodiment of this invention, the electrically-conductive layer contains non-conductive metal-containing filler particles partially substituted for various amounts of conductive colloidal zinc antimonate ($M^{+2}$=$Zn^{+2}$) particles, all dispersed in a film-forming polymeric binder, such as gelatin or a polyurethane. A wide variety of suitable non-conductive metal-containing filler particles can be substituted for the conductive metal antimonate particles including metal oxides, natural clays, synthetic clays, proto-clays, (e.g., imogolites), clay-like minerals, zeolites, micas, and the like. In a preferred embodiment, the combination of conductive zinc antimonate particles and non-conductive metal oxide particles results in improved optical transparency, decreased color, decreased haze, and only slightly decreased conductivity at substantially lower dry weight coverages of conductive zinc antimonate particles. Although coated layers can be prepared containing only non-conductive filler particles that are electrically-conductive at ambient relative humidity (~50% R.H.) because of the presence of various ionic species used to electrostatically stabilize the colloidal metal oxide particle dispersions, such layers typically exhibit substantially lower surface conductivities at low relative humidities (<20% R.H.) and after photographic processing and thus are unsuitable for permanent antistatic layers or electrodes for imaging elements.

Suitable non-conductive metal oxide particles including tin oxide, zinc oxide, antimony pentoxide, zinc antimonate, titania, zirconia, magnesia, yttria, ceria, germania, alumina, silica, alumina-modified silicas, and other surface-modified silicas prepared by various methods can be substituted for a substantial fraction (up to 75%) of the zinc antimonate in antistatic coatings without appreciably degrading the conductivity of the conductive layer. A wide variety of suitable colloidal size (~0.002–0.050 μm) metal oxide particles are commercially available. For example, suitable aqueous dispersions of non-conductive colloidal tin oxide particles are available from Nalco Chemical Co. and PQ Corp./Nyacol Products under the tradenames 88SN123 and SN-15, respectively. Dispersions of colloidal non-conductive zinc oxide and antimony pentoxide are available from PQ Corp./Nyacol Products under the tradenames DP5370 and JL527S, respectively. Dispersions of colloidal silica are available from Dupont Chemical under the tradename Ludox (e.g., Ludox AM, Ludox SM, etc.). Dispersions of colloidal alumina, titania, yttria, and zirconia are available from various other manufacturers as well. Although other electronically-conductive donor-doped or oxygen-deficient metal oxide colloidal particles (e.g., antimony-doped tin oxide) can be substituted either alone or in combination with non-conductive metal oxides for the metal antimonate, substitution of conductive zinc antimonate by other conductive metal oxides fails to achieve one or more advantages of the present invention (i.e., less haze, greater optical transparency, less color). Preferred non-conductive colloidal metal oxide particles for conductive layers of this invention include tin oxide, silica, and alumina-modified silica.

Other suitable colloidal inorganic filler materials include natural clays, such as kaolin, bentonite, and especially dispersible or delaminatable smectite clays such as montmorillonite, beidellite, hectorite, and saponite. Synthetic smectite clay materials such as a synthetic layered hydrous magnesium silicate which closely resembles the naturally occuring clay mineral hectorite in both composition and structure are preferred. Hectorite belongs to the class of clays and clay-related minerals known as "swellable" clays and is relatively rare and typically is contaminated with other minerals such as quartz or ionic species which are difficult to remove. A preferred synthetic hectorite which is free from contaminants can be prepared under controlled conditions and is available commercially from Laporte Industries, Ltd. under the tradename "Laponite". The crystallographic structure of this synthetic hectorite can be described as a three-layer hydrous magnesium silicate. The central layer contains magnesium ions octahedrally coordinated by oxygen, hydroxyl or fluoride ions, wherein the magnesium ions can be partially substituted with suitable monovalent ions such as lithium, sodium, potassium, and/or vacancies. This central octahedrally-coordinated layer is sandwiched between two other layers containing silicon ions tetrahedrally coordinated by oxygen ions. Individual hectorite clay particles can be readily swollen using deionized water and ultimately exfoliated to provide a stable aqueous dispersion of tiny platelets (smectites) with an average diameter of about 0.025–0.050 $\mu$m and an average thickness of about 0.001 $\mu$m known as a "sol". In the presence of alkali, alkaline earth or metal ions, electrostatic attractions between the individual platelets can produce various associative structures which exhibit extended ordering. Because of the readily reversible nature of the weak attractive forces, these structures can be easily broken and reformed, producing a highly thixotropic system exhibiting low viscosity under shear and a high yield value. Such a sol of synthetic hectorite platelets can be combined with a dispersion of a suitable polymeric film-forming binder and applied to a support to provide transparent layers which can be electrically-conductive at high clay to polymeric binder weight ratios and at relatively high relative humidity. Typically, such conductive layers are not suitable for use in photographic elements because the level of electrical conductivity provided is dependent on relative humidity and is substantially degraded by photographic processing. Further, at the high clay to binder weight ratios required to obtain adequate levels of conductivity, adhesion to the conductive layer can be poor. In addition, poor cohesion of such highly filled clay-containing conductive backing layers can produce unacceptable levels of dusting.

The ratio of the amount of conductive metal antimonate to polymeric binder in a conductive layer is one of the critical factors which influences the ultimate conductivity of that layer. If this ratio is too small, little or no antistatic property is exhibited. If the ratio is very large, adhesion between the conductive layer and the support or overlying layers can be diminished. The optimum ratio of conductive particles to binder can vary depending on the particle conductivity, particle size, binder type, total dry weight coverage or coating thickness, and the conductivity requirements. It is useful to express the fraction of zinc antimonate in the coated layer in terms of volume percent rather than weight percent since the densities of the components (i.e., filler particles and binders) can vary widely. The lowest volume percentage of zinc antimonate for which the layer is conductive is determined by the efficiency of conductive network formation by the metal antimonate particles which depends on such factors as particle size, particle-particle interactions, specific (volume) resistivity, type of polymeric binder, coating solvent(s), and additives (e.g., dispersing aids, colloid stabilizers, surfactants, coating aids, etc.) present as well as various other process-related factors, such as post-coating drying conditions. The fraction of conductive metal antimonate particles in the conductive layers of this invention that can be substituted by non-conductive filler particles depends primarily upon the type of binder, the weight density of the non-conductive filler particles, the total dry weight coverage as well as the required level of conductivity for the conductive layer. Other factors, such as the type of non-conductive filler particle and the strengths of various particle-particle interactions also can influence the extent of substitution. Further substitution of metal antimonate particles in the conductive layers by non-conductive metal-containing filler particles in accordance with this invention can result in manufacturing cost savings for imaging elements incorporating such layers.

In one preferred embodiment with zinc antimonate as the conductive particle, a suitable range for the weight percent of zinc antimonate is from about 20 to 85% of the weight of the coated layer after drying. This corresponds to a volume percent of zinc antimonate in the conductive layer ranging from about 4 to 50%. A suitable range for the weight percent of conductive zinc antimonate particles substituted by non-conductive filler particles is from about 10 to 80% in order to realize fully the advantages of the present invention. However, this range is strongly dependent on the particular polymeric binder(s) used, the total particle to binder weight ratio, as well as the total dry coverage. For example, in the case of a soluble, hydrophilic binder such as gelatin, less than about 20% of the zinc antimonate can be substituted by non-conductive filler for a total dry coverage of less than 0.4 g/m$^2$. In the case of an insoluble dispersed binder such as a polyurethane, over 50% of the zinc antimonate particles can be substituted by non-conductive filler particles. In addition, there is some variation in these ranges which is dependent on the particular type of non-conductive filler particle used. Thus, the conductive layer includes 10 to 75 volume percent of zinc antimonate, 2 to 45 volume percent of nonconductive filler particles and from 20 to 88 volume percent of the polymeric binder. The conductive layer preferably includes 10 to 50 volume percent of zinc antimonate, 5 to 45 volume percent of nonconductive filler particles and from 20 to 85 volume percent of the polymeric binder. The conductive layer most preferably includes 12 to 45 volume percent of zinc antimonate, 5 to 40 volume percent of nonconductive filler particles and from 20 to 83 volume percent of the polymeric binder.

Polymeric film-forming binders useful in conductive layers prepared by the method of this invention include: water-soluble, hydrophilic polymers such as gelatin, gelatin derivatives, maleic acid anhydride copolymers; cellulose derivatives such as carboxymethyl cellulose, hydroxyethyl cellulose, cellulose acetate butyrate, diacetyl cellulose or triacetyl cellulose; synthetic hydrophilic polymers such as polyvinyl alcohol, poly-N-vinylpyrrolidone, acrylic acid copolymers, polyacrylamide, their derivatives and partially hydrolyzed products, vinyl polymers and copolymers such as polyvinyl acetate and polyacrylate acid ester; derivatives of the above polymers; and other synthetic resins. Other suitable binders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, and olefins and aqueous dispersions of polyurethanes or polyesterionomers. Gelatin and gelatin derivatives, aqueous dispersed polyurethanes and polyesterionomers, and aqueous emulsions of vinylidene halide copolymers are preferred binders for conductive layers of this invention.

Solvents useful for preparing dispersions and coating formulations containing conductive metal antimonate particles and non-conductive filler particles include: water; alcohols such as methanol, ethanol, propanol, isopropanol; ketones such as acetone, methylethyl ketone, and methylisobutyl ketone; esters such as methyl acetate, and ethyl acetate; glycol ethers such as methyl cellusolve, ethyl cellusolve; ethylene glycol, and mixtures thereof. Preferred solvents include water, alcohols, and acetone.

In addition to the colloidal metal antimonate particles, colloidal non-conductive particles, and one or more suitable film-forming polymeric binders, other components that are well known in the photographic art also can be included in conductive layers of this invention. Other typical addenda, such as matting agents, surfactants or coating aids, polymer lattices to improve dimensional stability, thickeners or viscosity modifiers, hardeners or cross-linking agents, soluble antistatic agents, charge control agents, soluble and/or solid particle dyes, antifoggants, lubricating agents, and various other conventional additives optionally can be present in any or all of the layers of the multilayer imaging element of this invention.

Colloidal dispersions of conductive metal antimonate particles and non-conductive filler particles in suitable liquid vehicles can be formulated with polymeric film-forming binders and various addenda and applied to a variety of supports to form the electrically-conductive layers of this invention. Such supports can be either transparent or opaque (reflective). Transparent film supports can be either colorless or colored by the addition of a dye or pigment. Transparent support materials used in the practice of this invention may be comprised of any of a wide variety of synthetic high molecular weight polymeric films such as cellulose esters including cellulose diacetate, cellulose triacetate, cellulose acetate butyrate, cellulose acetate proprionate; cellulose nitrate; polyesters such as poly(ethylene terephthalate), poly (ethylene naphthalate) or poly(ethylene naphthalate) having included therein a portion of isophthalic acid, 1,4-cyclohexane dicarboxylic acid or 4,4-biphenyl dicarboxylic acid used in the preparation of the film support, polyesters wherein other glycols are employed such as, for example, cyclohexanedimethanol, 1,4-butanediol, diethylene glycol, polyethylene glycol; ionomers as described in U.S. Pat. No. 5,138,024, incorporated herein by reference, such as polyester ionomers prepared using a portion of the diacid in the form of 5-sodiosulfo-1,3-isophthalic acid or like ion containing monomers; polycarbonate; poly(vinyl acetal); polyolefins such as polyethylene, polypropylene; polystyrene; polyacrylates; and others; and blends or laminates of the above polymers. Of these film supports, cellulose triacetate, poly(ethylene terephthalate), and poly(ethylene naphthalate) prepared from 2,6-naphthalene dicarboxylic acids or derivatives thereof are preferred. Suitable opaque or reflective supports comprise paper, polymer-coated paper, including polyethylene-, polypropylene-, and ethylene-butylene copolymer-coated or laminated paper, synthetic papers, and pigment-containing polyesters and the like. The thickness of the support is not particularly critical. Support thicknesses of 2 to 10 mils (50 $\mu$m to 254 $\mu$m) are suitable for photographic elements in accordance with this invention. Photographic supports can be surface treated by various processes including corona discharge, glow discharge, UV exposure, flame treatment, e-beam treatment, and solvent washing or overcoated with adhesion promoting primer or tie layers containing polymers such as vinylidene chloride-containing copolymers, butadiene-based copolymers, glycidyl acrylate or methacrylate containing copolymers, maleic anhydride containing copolymers, and the like.

Dispersions containing colloidal conductive metal antimonate and non-conductive filler particles, a polymeric film-forming binder, and various additives in a suitable liquid vehicle can be applied to the aforementioned film or paper supports using any of a variety of well-known coating methods. Handcoating techniques include using a coating rod or knife or a doctor blade. Machine coating methods include air doctor coating, reverse roll coating, gravure coating, curtain coating, bead coating, slide hopper coating, extrusion coating, spin coating and the like, as well as other coating methods known in the art.

The electrically-conductive layer of this invention can be applied to the support at any suitable coverage depending on the specific requirements of a particular type of imaging element. For example, for silver halide photographic films, total dry weight coverages for conductive layers containing both conductive metal antimonate and non-conductive filler particles are preferably in the range of from about 0.01 to 2 g/m$^2$. More preferred total dry coverages are in the range of about 0.025 to 1 g/m$^2$. The conductive layers of this invention typically exhibit surface electrical resistivity (50% RH, 20° C.) values of less than 11 log ohms/square, preferably less than 10 log ohms/square, and more preferably less than 9 log ohms/square.

The imaging elements of this invention can be of many different types depending on the particular use for which they are intended. Such imaging elements include, for example, photographic, thermographic, electrothermographic, photothermographic, dielectric recording, dye migration, laser dye-ablation, thermal dye transfer, electrostatographic, electrophotographic imaging elements, thermally processable imaging elements and others described herinabove. Suitable photosensitive image-forming layers are those which provide color or black and white images. Such photosensitive layers can be image-forming layers containing silver halides such as silver chloride, silver bromide, silver bromoiodide, silver chlorobromide and the like. Both negative and reversal silver halide elements are contemplated. For reversal films, the emulsion layers described in U.S. Pat. No. 5,236,817, especially Examples 16 and 21, are particularly suitable. Any of the known silver halide emulsion layers, such as those described in *Research Disclosure,* Vol. 176, Item 17643 (December, 1978), *Research Disclosure,* Vol. 225, Item 22534 (January, 1983), *Research Disclosure,* Item 36544 (September, 1994), and *Research Disclosure,* Item 37038 (February, 1995) and the references cited therein are useful in preparing photographic elements in accordance with this invention.

In a particularly preferred embodiment, imaging elements comprising the electrically-conductive layers of this invention are photographic elements which can differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. Photographic elements can be either simple black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure,* Vol. 176, Item 17643 (Dec., 1978).

Imaging elements incorporating conductive layers of this invention also can comprise additional layers including adhesion-promoting layers, lubricant or transport-controlling layers, hydrophobic barrier layers, antihalation layers, abrasion and scratch protection layers, and other special function layers. Imaging elements incorporating conductive layers in accordance with this invention useful for specific imaging applications such as color negative films, color reversal films, black-and-white films, color and black-and-white papers, electrographic media, dielectric recording media, thermally processable imaging elements, thermal dye transfer recording media, laser ablation media, and other imaging applications should be readily apparent to those skilled in photographic and other imaging arts.

The present invention is illustrated by the following detailed examples of its practice. However, the scope of this invention is by no means restricted to these illustrative examples.

EXAMPLE 1

An aqueous antistatic coating formulation containing colloidal conductive zinc antimonate particles with an average primary particle size of 0.015 to 0.030 μm (by BET), colloidal non-conductive tin oxide particles with an average primary particle size of about 0.015 μm, gelatin, and dihydroxydioxane as a hardener was prepared at nominally 2.1% total solids by weight as described below. The weight ratio of zinc antimonate to non-conductive tin oxide to gelatin binder was nominally 70:15:15. The corresponding volume ratio is 42:8:50. The coating formulation is given below:

| Component | Weight % (wet) |
|---|---|
| $ZnSb_2O_6$ (CELNAX CX-Z, Nissan Chemical Industries,Ltd..) | 1.481 |
| Gelatin | 0.317 |
| Non-conductive $SnO_2$ (SN-15, PQ Corp., Nyacol Products) | 0.317 |
| Dihydroxydioxane (DHD) hardener | 0.0095 |
| Distilled water | 97.876 |

The above coating formulation was applied to a moving web of 7 mil (180 μm) thick poly(ethylene terephthalate) film support using a coating hopper so as to provide a nominal dry coverage (i.e., zinc antimonate plus filler plus binder) of 0.3 g/m$^2$. The film support had been coated previously with a typical primer layer consisting of a terpolymer latex of acrylonitrile, vinylidene chloride, and acrylic acid.

The resulting conductive layer was overcoated subsequently with a pelloid layer containing gelatin, bisvinylmethane sulfone as a hardener, polymeric matte particles, antihalation dye, and a coating aid to provide a curl-control function. This hydrophilic curl control layer was coated so as to produce a nominal dry coverage of about 1.8 g/m$^2$ based on total solids.

The electrical performance and optical transparency of the various conductive layers prepared as described herein were evaluated. Surface electrical resistivity (SER) of the conductive layers was measured at nominally 20° C. and at 20 and 50% relative humidity using a two-point DC electrode method similar to that described in U.S. Pat. No. 2,801,191. Antistatic performance of the conductive layer after overcoating with a pelloid layer was evaluated by measuring the internal electrical resistivity using a salt bridge wet electrode resistivity (WER) measurement technique such as described in "Resistivity Measurements on Buried Conductive Layers" by R. A. Elder, pages 251–254, 1990 *EOS/ESD Symposium Proceedings*. Generally, antistatic layers with WER values greater than about 12 log ohms/square are considered to be ineffective at providing static protection for photographic imaging elements. For adequate antistatic performance, conductive layers with WER values of 10 log ohms/square or less are preferred. Further, SER values were measured for the antistatic layers and WER values for overcoated antistatic layers after micrographic film processing.

Total optical (ortho) and ultraviolet densities ($D_{min}$) were evaluated at 530 nm and 380 nm, respectively, using a X-Rite Model 361T transmission densitometer. Net or ΔUV $D_{min}$ and net or ΔOrtho $D_{min}$ values were calculated by correcting the total ultraviolet and optical densities for the contributions from the support. Descriptions of the compositions of the antistatic layers, surface resistivity values, internal resistivity values, and net ultraviolet and optical densities are given in Table 1.

COMPARATIVE EXAMPLES 1–3

Conductive layers containing colloidal conductive zinc antimonate particles with an average primary particle size of 0.015 to 0.030 μm (by BET), gelatin, dihydroxydioxane as a hardener, and various other additives were prepared as described for Example 1 except for the omission of the non-conductive tin oxide filler particles. The weight ratios of zinc antimonate to gelatin binder were nominally 70:30, 85:15, and 77.5:22.5 for the conductive layers of Comparative Examples 1, 2, and 3, respectively. The corresponding volume ratios are given in Table 1. These conductive layers also were overcoated with gelatin-containing pelloid layers as described in Example 1. The surface resistivity values, internal resistivity values, and net ultraviolet and optical densities are given in Table 1.

EXAMPLE 2

An aqueous antistatic coating formulation containing colloidal conductive zinc antimonate particles with an average primary particle size of 0.015 to 0.030 μm (by BET), colloidal synthetic hectorite clay particles with an average platelet size of about 0.025 μm in diameter and about 0.001 μm in thickness (by TEM), gelatin, and dihydroxydioxane as a hardener was prepared at nominally 2.1% total solids as described in Example 1. The weight ratio of zinc antimonate to synthetic clay to gelatin binder was nominally 70:15:15. The corresponding volume ratio is 36:20:44. The coating formulation is given below:

| Component | Weight % (wet) |
|---|---|
| $ZnSb_2O_6$ (CELNAX CX-Z, Nissan Chemical Ind.) | 1.481 |
| Gelatin | 0.317 |
| Clay (Laponite RDS, Laporte Industries Ltd.) | 0.317 |
| Dihydroxydioxane (DHD) hardener | 0.009 |
| Distilled water | 97.876 |

The above coating formulation was applied to a moving web of 7 mil (180 $\mu$m) thick polyester terephthalate film support using a coating hopper so as to provide a nominal dry coverage (i.e., zinc antimonate plus clay plus gelatin) of 0.3 g/m$^2$. The film support had been coated previously with a typical primer layer consisting of a terpolymer latex of acrylonitrile, vinylidene chloride, and acrylic acid. The conductive layer was overcoated with a gelatin-containing pelloid layer as described in Example 1. Surface resistivity values, internal resistivity values, and net ultraviolet and optical densities ($D_{min}$) are given in Table 1.

COMPARATIVE EXAMPLE 4

A conductive layer containing colloidal synthetic hectorite clay particles with an average platelet size of about 0.025 $\mu$m in diameter and about 0.001 $\mu$m in thickness (by TEM), gelatin, dihydroxydioxane as a hardener, and various other additives was prepared as described for Example 2 except that synthetic hectorite clay was substituted for all the conductive zinc antimonate. The weight ratio of synthetic clay to gelatin binder was nominally 85:15. The corresponding volume ratio is 73:27. This conductive layer was overcoated with a gelatin-containing pelloid layer as described in Example 2. Surface resistivity values, internal resistivity values, and net ultraviolet and optical densities are given in Table 1.

EXAMPLES 3–7

Aqueous antistatic backing formulations containing colloidal conductive zinc antimonate particles with an average primary particle size of 0.015 to 0.030 $\mu$m (by BET), various colloidal non-conductive metal oxide filler particles of comparable or smaller size, gelatin, dihydroxydioxane as a hardener, polymeric matte beads, and wetting aid were prepared at nominally 2.2% total solids with various other non-conductive colloidal metal oxide filler particles substituted for the zinc antimonate particles. The 0.8 $\mu$m polymeric matte beads were prepared in accordance with U.S. Pat. No. 5,563,226. Another colloidal tin oxide with a mean particle size of <0.010 $\mu$m, available under the tradename 88SN123 from Nalco Chemical Co., was used in the conductive layer of Example 3. Colloidal zinc oxide with a mean particle size of about 0.020 $\mu$m, available under the tradename DP5370 from PQ Corp./ Nyacol Products was used in the conductive layer of Example 4. Colloidal antimony pentoxide with a mean particle size of about 0.005 $\mu$m, available under the tradename JL527S from PQ Corp./ Nyacol Products was used in the conductive layer of Example 5. Colloidal silicas with mean particle sizes of about 0.007 to 0.012 $\mu$m, available under the tradenames Ludox AM and Ludox SM from Dupont Chemical were used in the conductive layers of Examples 6 and 7, respectively. The weight ratio of zinc antimonate to non-conductive metal oxide filler to gelatin binder was held constant at nominally 70:15:15 for all of these conductive layers. The corresponding volume ratios are given in Table 1. The generalized coating formulation is given below:

| Component | Weight % (wet) |
|---|---|
| $ZnSb_2O_6$ (CELNAX CX-Z, Nissan Chemical Ind.) | 1.481 |
| Gelatin | 0.317 |
| Non-conductive colloidal metal oxide | 0.317 |
| Dihydroxydioxane (DHD) hardener | 0.009 |
| Matte beads, 0.8 $\mu$m | 0.038 |
| Wetting aid (10 G, Dixie Chemical Co.) | 0.034 |
| Distilled water | 97.804 |

The above coating formulation was applied to a moving web of 7 mil (180 $\mu$m) thick polyester terephthalate film support using a coating hopper so as to provide a nominal dry coverage (i.e., zinc antimonate plus metal oxide filler plus binder) of 0.3 g/m$^2$. The film support had been coated previously with a typical primer layer consisting of a terpolymer latex of acrylonitrile, vinylidene chloride, and acrylic acid. Surface resistivity values before and after processing and net ultraviolet and optical densities are given in Table 1.

The propensity for backing layers containing matte particles to dust was evaluated by subjecting the support onto which the layer was coated to a load and drawing the coated layer across rough, black interleaving paper. The amount of matte particles that are transferred in the process is rated relative to a standard with a rating of 1 being the best and a rating of 4 being the worst. The dusting performance of the conductive layers of Examples 3–7 was evaluated and the results given in Table 1.

Polymeric colloidal filler particles also can be introduced into a conductive layer containing conductive zinc antimonate particles by blending a water-insoluble polymer in the form of an aqueous dispersion or latex with an aqueous dispersion of conductive colloidal metal oxide particles and gelatin during the formulation of the coating solutions as described in U.S. Pat. No. 5,340,676. Suitable non-conductive polymer particles can be either film-forming (e.g., a dispersed polyurethane or a polybutylmethacrylate latex such as poly(n-butyl methacrylate-co-acrylamido-2-methylpropane sulfonic acid, sodium salt 95:5 (PBMA-AMPS), poly(n-butyl methacrylate-co-methacrylic acid 95:5 (PBMA-MAA) or poly(n-butyl methacrylate-co-sodium styrene sulfonate) 95:5 (PBMA-SSS) or non-film-forming (e.g., a polymethyl methacrylate such as poly (methylmethacrylate-co-methylacrylic acid (PMMA-MAA) or crosslinked insoluble gelatin). Such polymer particles also must be relatively small in size (i.e., 0.001–0.30 $\mu$m).

COMPARATIVE EXAMPLE 5

A conductive backing layer containing colloidal conductive zinc antimonate particles with an average primary particle size of 0.015 to 0.030 $\mu$m (by BET) in water, poly(n-butyl methacrylate-co-acrylamido-2-methylpropane sulfonic acid, sodium salt, 95:5 (PBMA-AMPS) latex particles with a mean diameter of about 0.065 $\mu$m, gelatin, dihydroxydioxane as a hardener, polymeric matte particles, and various other additives was prepared as described in Example 3 with the PBMA-AMPS latex particles substituted for the colloidal tin oxide particles. The weight ratio of zinc antimonate to PBMA-AMPS to gelatin binder was nominally 70:15:15. The corresponding volume ratio is 30:35:35. Surface resistivity values, net ultraviolet and optical densities, and dusting values are given in Table 1.

COMPARATIVE EXAMPLE 6

A conductive layer containing colloidal conductive zinc antimonate particles with an average primary particle size of 0.015 to 0.030 μm (by BET) in water, polyurethane particles (i.e., Witcobond W-232, Witco Chemical Co.), gelatin, dihydroxydioxane as a hardener, polymeric matte particles, and various other additives was prepared as described in Example 3 with the polyurethane particles substituted for the colloidal tin oxide particles. The weight ratio of zinc antimonate to polyurethane to gelatin binder was nominally 75:11:14. The corresponding volume ratio is 35:28:37. Surface resistivity values and net ultraviolet and optical densities are given in Table 1.

TABLE 1

Conductive layers containing gelatin as film forming binder

| Sample | % ZA[1] weight | % ZA[1] volume | % NCF[2] weight | % NCF[2] volume | Raw SER[4] 50% RH | Raw SER[4] 20% RH | ΔUV $D_{min}$ | ΔOrtho $D_{min}$ | Processed SER[4] 50% RH | Processed SER[4] 20% RH | Pelloid Raw WER[4] | Pelloid Processed WER[4] | Dusting |
|---|---|---|---|---|---|---|---|---|---|---|---|---|---|
| Ex. 1 | 70 | 42 | 15 | 8 | 8.1 | 7.8 | 0.005 | 0.006 | 8.6 | 8.4 | 9.2 | 9.0 | **[3] |
| C. Ex. 1 | 70 | 30 | 0 | 0 | 8.6 | 8.2 | 0.004 | 0.005 | 9.6 | 8.8 | 10.3 | 10.5 | ** |
| C. Ex. 2 | 85 | 50 | 0 | 0 | 7.6 | 7.3 | 0.003 | 0.007 | 8.3 | 7.9 | 7.8 | | ** |
| C. Ex. 3 | 77.5 | 38 | 0 | 0 | 7.7 | 7.7 | 0.004 | 0.005 | 8.6 | 8.1 | 8.9 | 9.5 | ** |
| Ex. 2 | 70 | 36 | 15 | 20 | 8.7 | 8.4 | 0.003 | 0.005 | 8.9 | 8.9 | 9.5 | 8.3 | ** |
| C. Ex. 4 | 0 | 0 | 85 | 73 | 11.9 | 10.0 | 0.000 | 0.000 | 10.0 | 12.1 | 11.3 | 12.0 | ** |
| Ex. 3 | 70 | 42 | 15 | 8 | 9.8 | 9.6 | 0.020 | 0.013 | 9.6 | 9.1 | ** | ** | 2 |
| Ex. 4 | 70 | 41 | 15 | 10 | 10.6 | 10.2 | 0.031 | 0.011 | 9.1 | 8.4 | ** | ** | 1 |
| Ex. 5 | 70 | 39 | 15 | 15 | 10.3 | 10.0 | 0.020 | 0.011 | 10.7 | 11.1 | ** | ** | 2 |
| Ex. 6 | 70 | 36 | 15 | 20 | 8.6 | 8.3 | 0.027 | 0.004 | 8.6 | 8.1 | ** | ** | 1 |
| Ex. 7 | 70 | 36 | 15 | 20 | 9.5 | 9.0 | 0.018 | 0.008 | 9.7 | 9.2 | ** | ** | 1 |
| C. Ex. 5 | 70 | 30 | 15 | 35 | 10.8 | 10.5 | 0.014 | 0.006 | 10.0 | 9.5 | ** | ** | 3 |
| C. Ex. 6 | 75 | 35 | 11 | 28 | 11.3 | ** | 0.021 | 0.010 | ** | ** | ** | ** | ** |

[1]ZA = zinc antimonate
[2]NCF = non-conductive filler particle (i.e., colloidal metal oxide, synthetic clay or insoluble polymer)
[3]**= indicates "not measured"
[4]SER and WER units = log ohm/square The above Examples demonstrate that about 20% by weight of the colloidal conductive zinc antimonate particles in the conductive layers of this invention can be substituted by comparable size or smaller non-conductive colloidal inorganic filler particles to produce comparable or slightly higher SER values. Such substituted conductive layers at nominally equivalent total dry weight coverage (about 0.3 $g/m^2$) and constant weight ratio of total particles (zinc antimonate+non-conductive filler) to binder (gelatin) of 85:15, exhibit comparable or slightly higher (<1 log ohm/square) SER values than unsubstituted layers containing comparable weight percentages of zinc antimonate. For example, the SER values for the conductive layer of Example 1 containing 70% zinc antimonate by weight (42% by volume) and 15% SN-15 non-conductive tin oxide by weight (9% by volume) is substantially lower than that for the conductive layer of Comparative Example 1 which also contains 70% zinc antimonate by weight (30% by volume) but no non-conductive filler at 20 and 50% RH before overcoating with a pelloid and also after processing. Further, the WER values for the conductive layer of Example 1 after overcoating with a pelloid layer are lower than the corresponding values for Comparative Example 1 both before and after processing as well. Comparison of SER values for the conductive layer of Example 1 before overcoating with a pelloid layer with SER values for the conductive layer of Comparative Example 3 containing 77.5% zinc antimonate by weight (38% by volume) reveals nearly identical electrical performance at 20 and 50% RH both before and after processing. Also, the WER values were comparable for the conductive layers of Example 1 and Comparative Example 3 after overcoating with a pelloid both before and after processing. Comparison of SER values for the conductive layer of Example 1 before overcoating with those for the conductive layer of Comparative Example 2 containing 85% conductive zinc antimonate by weight (50% by volume) reveals only slightly better electrical performance for the conductive layer of Comparative Example 2 despite the substantially greater amount (viz., >20% by weight) of conductive zinc antimonate present. Similar results were obtained for the conductive layer of Example 2 containing 70% conductive zinc antimonate by weight (36% by volume) and 15% synthetic hectorite clay by weight (20% by volume) as the non-conductive filler. The SER values for the conductive layer of Comparative Example 4 containing 85% synthetic hectorite clay by weight (73% by volume) and no zinc antimonate reveal that the intrinsic ionic conductivity of the synthetic hectorite clay does not produce as conductive a layer as any of the layers containing zinc antimonate. Further, the increase in SER for the conductive layer of Example 4 by nearly 2 log ohms/square after processing demonstrates the need to provide a protective hydrophobic overcoat for such clay-based conductive coatings.

The change in resistivity (ΔR=WER-SER) of the conductive layer after overcoating with a pelloid layer is also a measure of the robustness of the conductive network in the conductive layer. Rewetting of the surface and penetration by coating solvent into the bulk of the conductive layer during the overcoating process can cause swelling of the binder and intermixing resulting in decreased conductivity of the overcoated conductive layer. The magnitude of the observed increase in resistivity of the conductive layer after overcoating can depend on binder selection for both layers, conductive particle to binder ratio in the conductive layer, total dry coverage for both layers, drying conditions for both layers, and other process-related factors. The increases in resistivity for the conductive layers of Examples 1 and 2 containing zinc antimonate partially substituted with non-conductive filler particles after overcoating with pelloid layers are less than 1 log ohm/square. The increases in resistivity for the conductive layers of Comparative Examples 1 and 3 containing 70 and 77.5% zinc antimonate by weight (30 and 38% by volume) unsubstituted by non-conductive filler are greater than 1 log ohm/square. However, the increases in resistivity for the conductive layers of Comparative Examples 2 and 4 containing 85% by weight of either zinc antimonate (50% by volume) or synthetic clay (73% by volume) were very small after overcoating with a gelatin pelloid layer. Thus, the magnitude of the increase in resistivity depends on the the total volume fraction of particles (i.e., zinc antimonate and non-conductive filler) present in the conductive layer. This is because at high volume fractions of particles (i.e., low volume fraction of polymeric binder), there is less swelling and intermixing of the conductive layer during the overcoating process. Thus, conductive layers of this invention exhibit less increase in resistivity after overcoating than do unsubstituted conductive layers containing comparable weight percentages of zinc antimonate.

Partial substitution of conductive zinc antimonate particles by other colloidal metal oxide particles gave conductive layers (Examples 3–7) with somewhat higher SER values with the exception of Ludox AM and SM silicas. In addition, the ΔUV $D_{min}$ values for the conductive layers of Examples 3–7 are typically somewhat higher than those for the conductive layers of Examples 1 and 2 and Comparative Examples 1–4 because of the presence of polymeric matte particles. The conductive layer of Example 6 containing 15% Ludox AM silica particles by weight (20% by volume) exhibited SER values nearly identical to those for the conductive layers of Examples 1 and 2 and Comparative Example 1. Film-forming polymeric filler particles, such as polybutylmethacrylate latex particles (PBMA-AMPS) and dispersed polyurethane particles (Witcobond W-232), also can be substituted for zinc antimonate particles in the same manner as colloidal metal oxide or synthetic clay particles. Conductive coatings containing polymeric filler particles (Comparative Examples 5 and 6) gave SER values less than about 11 log ohms/square at 50% RH. These SER values are comparable to values obtained by substituting zinc antimonate particles with colloidal zinc oxide or antimony pentoxide (Examples 4 and 5). Similar results have been disclosed in U.S. Pat. No. 5,340,676 for conductive layers containing colloidal conductive antimony-doped tin oxide particles and various water-insoluble polymer particles dispersed in gelatin. Further, U.S. Pat. No. 5,466,567 teaches the use of non-film-forming polymeric particles such as insoluble crosslinked gelatin particles as non-conductive filler particles substituted for colloidal conductive tin oxide particles in a conductive layer. For example, a conductive layer containing 50% conductive tin oxide particles, 33% crosslinked gelatin particles, and 17% soluble gelatin by weight (15% tin oxide by volume) exhibited an SER value of 9.5 log ohms/square compared with 8.9 log ohms/square for a conductive layer containing 80% conductive tin oxide particles and 20% soluble gelatin by weight (40% tin oxide by volume). The electrical properties of conductive layers containing such insoluble non-film-forming, cross-linked gelatin particles are comparable to conductive layers containing colloidal non-conductive inorganic filler particles of the present invention. However, because the weight density of the crosslinked gelatin particles is closer to that of soluble gelatin than the inorganic fillers, the total volume fraction of the conductive layer occupied by particles is larger than for conductive layers containing comparable weight ratios of zinc antimonate and non-conductive inorganic filler particles. Further, the increase in resistivity for conductive layers containing crosslinked gelatin filler particles substituted for conductive tin oxide particles is anticipated to be greater than for inorganic filler particles because the crosslinked gelatin also can swell during the overcoating process.

EXAMPLES 8–10

Aqueous antistatic coating formulations containing colloidal conductive zinc antimonate particles with an average primary particle size of 0.015 to 0.030 μm (by BET), colloidal synthetic hectorite clay particles with an average platelet size of about 0.025 μm in diameter and about 0.001 μm in thickness (by TEM), aqueous dispersed polyurethane binder, and various other additives described below were prepared. The weight ratios of the zinc antimonate to the synthetic clay to the polyurethane binder were nominally 55:15:30, 45:25:30, and 40:20:40 for the conductive layers of Examples 8, 9, and 10, respectively. These ratios expressed in terms of volume percents are given in Table 2. The coating formulations are given below:

| | Weight % (wet) | | |
|---|---|---|---|
| Component | Ex. 8 | Ex. 9 | Ex. 10 |
| $ZnSb_2O_6$[1] | 1.681 | 1.375 | 1.223 |
| Clay[2] | 0.458 | 0.764 | 0.610 |
| Polyurethane[3] | 0.917 | 0.917 | 1.222 |
| Wetting aid[4] | 0.033 | 0.033 | 0.033 |
| Deionized water | 96.911 | 96.911 | 96.912 |

[1]CELNAX CX-Z, Nissan Chemical Ind.
[2]Laponite RDS, Laporte Industries Ltd.
[3]Witcobond W-236, Witco Chemical
[4]Triton X-100, Rohm & Haas The above coating formulations were applied to a moving web of 4 mil (100 μm) thick poly(ethylene terephthalate) film support using a coating hopper so as to provide nominal total dry coverages (i.e., zinc antimonate plus clay plus binder plus wetting aid) of 1 g/m$^2$ Examples 8a, 9a, 10a), 0.6 g/m$^2$ (Examples 8b, 9b, 10b), and 0.3 g/m$^2$ (Examples 8c, 9c, 10c). The film support had been coated previously with a typical primer layer consisting of a terpolymer latex of acrylonitrile, vinylidene chloride, and acrylic acid. Surface resistivity values, internal resistivity values, and net ultraviolet and optical densities are given in Table 2.

EXAMPLES 11–13

Aqueous antistatic coating formulations containing colloidal conductive zinc antimonate particles with an average primary particle size of 0.015 to 0.030 μm (by BET), colloidal tin oxide particles with an average primary particle size of about 0.015 μm, aqueous dispersed polyurethane binder, and various other additives described below were prepared at nominally 2.9% total solids by weight. The weight ratios of zinc antimonate to tin oxide to polyurethane binder were nominally 43.5:32.5:24, 33:54:13, and 22:59:19 for the conductive layers of Examples 11, 12, and 13, respectively. These ratios expressed in terms of volume percents are given in Table 2. The coating formulations are given below:

| | Weight % (wet) | | |
|---|---|---|---|
| Component | Ex. 11 | Ex. 12 | Ex. 13 |
| $ZnSb_2O_6$[1] | 1.268 | 0.940 | 0.626 |
| Colloidal tin oxide[2] | 0.962 | 1.568 | 1.741 |
| Polyurethane[3] | 0.693 | 0.376 | 0.537 |
| Wetting aid[4] | 0.026 | 0.022 | 0.021 |
| Deionized water | 97.051 | 97.094 | 97.075 |

[1]CELNAX CX-Z, Nissan Chemical Ind.
[2]SN-15, PQ Corporation, Nyacol Products
[3]Witcobond W-236, Witco Chemical
[4]Triton X-100, Rohm & Haas The above coating formulations were applied to a moving web of 4 mil (100 μm) thick poly(ethylene terephthalate) film support using a coating hopper so as to provide nominal total dry coverages of 1 g/m$^2$ (Examples 11a, 12a, 13a) and 0.6 g/m$^2$ (Examples 11b, 12b, 13b). The film support had been coated previously with a typical primer layer consisting of a terpolymer latex of acrylonitrile, vinylidene chloride, and acrylic acid.

EXAMPLES 14–16

Aqueous antistatic coating formulations containing colloidal conductive zinc antimonate particles with an average primary particle size of 0.015 to 0.030 μm (by BET), colloidal alumina-modified silica particles with an average primary particle size of about 0.007 μm, aqueous dispersed polyurethane binder, and various other additives described below were prepared at nominally 3.0–3.1% total solids by weight. The weight ratios of zinc antimonate to silica to polyurethane binder were nominally 56:13:31, 52:27:21, and 41.5:18:40.5 for the conductive layers of Examples 14, 15, and 16, respectively. These ratios expressed in terms of volume percents are given in Table 2. The coating formulations are given below:

| | Weight % (wet) | | |
|---|---|---|---|
| Component | Ex. 14 | Ex. 15 | Ex. 16 |
| $ZnSb_2O_6$[1] | 1.675 | 1.555 | 1.251 |
| Colloidal silca[2] | 0.402 | 0.821 | 0.550 |
| Polyurethane[3] | 0.915 | 0.622 | 1.251 |
| Wetting aid[4] | 0.034 | 0.034 | 0.034 |
| Deionized water | 96.974 | 96.968 | 96.914 |

[1]CELNAX CX-Z, Nissan Chemical Ind.
[2]LUDOX AM, Dupont Chemicals
[3]Witcobond W-236, Witco Chemical
[4]Triton X-100, Rohm & Haas The above coating formulations were applied to a moving web of 4 mil (100 μm) thick poly(ethylene terephthalate) film support using a coating hopper so as to provide nominal total dry coverages of 1 g/m$^2$ (Examples 14a, 15a, 16a) and 0.6 g/m$^2$ (Examples 14b, 15b, 16b). The film support had been coated previously with a typical primer layer consisting of a terpolymer latex of acrylonitrile, vinylidene chloride, and acrylic acid.

COMPARATIVE EXAMPLE 7

An aqueous antistatic coating formulation containing colloidal conductive zinc antimonate particles with an average primary particle size of 0.015 to 0.030 μm (by BET), aqueous dispersed polyurethane binder, and wetting aid was prepared as described for Example 8 except for the substitution of the synthetic clay filler particles by colloidal conductive zinc antimonate. The weight ratio of zinc antimonate to polyurethane binder was nominally 70:30. The corresponding volume ratio is 30:70. The above coating formulation was applied to a moving web of 4 mil (100 μm) thick poly(ethylene terephthalate) film support using a coating hopper so as to provide nominal total dry coverages of 1 g/m$^2$ (Comparative Example 7a) and 0.6 g/m$^2$ (Comparative Example 7b). The film support had been coated previously with a typical primer layer consisting of a terpolymer latex of acrylonitrile, vinylidene chloride, and acrylic acid. The surface resistivity values, internal resistivity values, and net ultraviolet and optical densities are given in Table 2.

COMPARATIVE EXAMPLE 8

Conductive layers containing colloidal synthetic hectorite clay particles with an average platelet size of about 0.025 μm in diameter and about 0.001 μm in thickness (by TEM), aqueous dispersed polyurethane binder, and various other additives were prepared as described in Example 8 except that synthetic hectorite clay filler was substituted for all the conductive zinc antimonate. The weight ratio of synthetic clay to polyurethane binder was nominally 70:30. Conductive layers were coated as described in Example 8 at nominal total dry coverages (i.e., clay plus binder plus wetting aid) of 1 and 0.6 g/m$^2$ for the conductive layers of Comparative Examples 8a and 8b. Surface resistivity values and net ultraviolet and optical densities are given in Table 2.

COMPARATIVE EXAMPLES 9–12

Conductive layers containing colloidal conductive zinc antimonate particles with an average primary particle size of 0.015 to 0.030 μm (by BET), polyurethane binder (Witcobond W-236), and various other additives were prepared similarly to those described in Example 8 except for the omission of synthetic hectorite clay filler particles. The weight ratios of zinc antimonate to polyurethane binder were nominally 50:50, 30:70, 80:20,and 60:40 for the conductive layers of Comparative Examples 9, 10, 11, and 12, respectively. These ratios expressed in terms of volume percents are given in Table 2. Surface resistivity values and net ultraviolet and optical densities appear in Table 2.

TABLE 2

| Conductive layers containing polyurethane (Witcobond W-236) as film forming binder | | | | | | | | |
|---|---|---|---|---|---|---|---|---|
| Sample | % ZA[1] weight | % ZA[1] volume | % NCF[2] weight | % NCF[2] volume | Total Dry Coverage[3] | SER[4] @ 50% RH | ΔUV $D_{min}$ | ΔOrtho $D_{min}$ |
| Ex. 8a | 55 | 21 | 15 | 15 | 1 | 8.3 | 0.041 | 0.011 |
| Ex. 8b | 55 | 21 | 15 | 15 | 0.6 | 8.7 | 0.026 | 0.009 |
| Ex. 8c | 55 | 21 | 15 | 15 | 0.3 | 9.5 | 0.020 | 0.007 |
| Ex. 9a | 45 | 16 | 25 | 24 | 1 | 8.7 | 0.032 | 0.009 |
| Ex. 9b | 45 | 16 | 25 | 24 | 0.6 | 9.0 | 0.021 | 0.007 |
| Ex. 10a | 40 | 13 | 20 | 17 | 1 | 9.6 | 0.028 | 0.007 |
| Ex. 10b | 40 | 13 | 20 | 17 | 0.6 | 10.3 | 0.020 | 0.006 |
| Ex. 11a | 43.5 | 21 | 32.5 | 15 | 1 | 8.9 | 0.026 | 0.008 |
| Ex. 11b | 43.5 | 21 | 32.5 | 15 | 0.6 | 9.2 | 0.020 | 0.009 |
| Ex. 12a | 33 | 21 | 54 | 33 | 1 | 9.1 | 0.024 | 0.008 |
| Ex. 12b | 33 | 21 | 54 | 33 | 0.6 | 9.4 | 0.018 | 0.007 |
| Ex. 13a | 22 | 12 | 59 | 31 | 1 | 10.4 | 0.018 | 0.007 |
| Ex. 13b | 22 | 12 | 59 | 31 | 0.6 | 10.5 | 0.012 | 0.008 |
| Ex. 14a | 56 | 21 | 13 | 15 | 1 | 8.5 | 0.042 | 0.014 |
| Ex. 14b | 56 | 21 | 13 | 15 | 0.6 | 8.7 | 0.029 | 0.012 |
| Ex. 15a | 52 | 21 | 27 | 33 | 1 | 8.7 | 0.032 | 0.007 |

TABLE 2-continued

Conductive layers containing polyurethane (Witcobond W-236) as film forming binder

| Sample | % ZA[1] weight | % ZA[1] volume | % NCF[2] weight | % NCF[2] volume | Total Dry Coverage[3] | SER[4] @ 50% RH | ΔUV $D_{min}$ | ΔOrtho $D_{min}$ |
|---|---|---|---|---|---|---|---|---|
| Ex. 15b | 52 | 21 | 27 | 33 | 0.6 | 8.9 | 0.021 | 0.006 |
| Ex. 16a | 41.5 | 13 | 18 | 17 | 1 | 9.4 | 0.032 | 0.011 |
| Ex. 16b | 41.5 | 13 | 18 | 17 | 0.6 | 9.7 | 0.024 | 0.009 |
| Comp. Ex. 7a | 70 | 30 | 0 | 0 | 1 | 8.0 | 0.050 | 0.017 |
| Comp. Ex. 7b | 70 | 30 | 0 | 0 | 0.6 | 8.4 | 0.035 | 0.015 |
| Comp. Ex. 8a | 0 | 0 | 70 | 52 | 1 | 11.3 | 0.000 | 0.000 |
| Comp. Ex. 8b | 0 | 0 | 70 | 52 | 0.6 | 11.4 | 0.000 | 0.000 |
| Comp. Ex. 9a | 50 | 15 | 0 | 0 | 1 | 9.1 | 0.040 | 0.015 |
| Comp. Ex. 9b | 50 | 15 | 0 | 0 | 0.6 | 9.4 | 0.027 | 0.012 |
| Comp. Ex. 10 | 30 | 7 | 0 | 0 | 1 | 13.7 | 0.023 | 0.005 |
| Comp. Ex. 11a | 80 | 42 | 0 | 0 | 1 | 7.7 | 0.048 | 0.012 |
| Comp. Ex. 11b | 80 | 42 | 0 | 0 | 0.6 | 8.1 | 0.033 | 0.010 |
| Comp. Ex. 12a | 60 | 21 | 0 | 0 | 1 | 8.5 | 0.047 | 0.018 |
| Comp. Ex. 12b | 60 | 21 | 0 | 0 | 0.6 | 8.9 | 0.034 | 0.014 |

[1]ZA = zinc antimonate
[2]NCF = non-conductive filler particle (i.e., Laponite RDS clay; SN-15 tin oxide; LUDOX AM silica)
[3]Total Dry Coverage = $g/m^2$
[4]SER units = log ohm/square The above Examples demonstrate that a substantial fraction of the zinc antimonate particles in conductive layers of this invention can be substituted by non-conductive metal-containing filler particles such as synthetic hectorite clay, colloidal tin oxide or colloidal silica surface-modified with alumina to give conductive layers with SER values comparable to those for layers containing higher weight fractions of unsubstituted zinc antimonate. More specifically, the substituted conductive layers of this invention exhibit comparable or only slightly higher (<1 log ohm/sq) SER values when coated at nominally equivalent total dry weight coverages (e.g., 0.3, 0.6, and 1 $g/m^2$) and constant weight ratios of total particles (i.e., zinc antimonate plus non-conductive filler) to binder (polyurethane) of 60:40 or greater, than unsubstituted layers containing higher weight percentages of zinc antimonate. Further, conductive layers containing nominally equivalent volume percentages of zinc antimonate exhibit comparable SER values in the presence of up to 30 volume percent of any of the non-conductive filler particles in accordance with this invention. For example, the SER values for the conductive layers of Examples 8, 11, 12, 14, and 15 containing nominally 21% zinc antimonate by volume (33 to 56% by weight), range from 8.3 to 9.1 log ohms/square for a total dry weight coverage of 1 $g/m^2$ and from 8.7 to 9.4 log ohms/square for a total dry weight coverage of 0.6 $g/m^2$. The conductive layers of Comparative Example 12 containing 21% unsubstituted zinc antimonate by volume (60% by weight) also exhibit SER values of 8.5 and 8.9 log ohms/square for total dry coverages of 1 and 0.6 $g/m^2$, respectively. Similarly, the conductive layers of Example 9 containing nominally 16% zinc antimonate by volume (45% by weight) exhibit SER values of 8.7 and 9.0 log ohms/square for total dry coverages of 1 and 0.6 $g/m^2$. The SER values for the conductive layers of Example 9 are somewhat lower than those for the conductive layers of Comparative Example 9 containing nominally 15% unsubstituted zinc antimonate by volume (50% by weight) for the same total dry coverages. Further, the SER values for the conductive layers of Examples 10 and 16 containing nominally 13% zinc antimonate by volume (40 and 56% by weight) were 9.4 and 9.6 log ohms/square, respectively, for a total dry coverage of 1 $g/m^2$ and 9.7 and 10.3 log ohms/square for a total dry coverage of 0.6 $g/m^2$. These SER values are comparable to those for the conductive layers of Comparative Example 9 containing 15% unsubstituted zinc antimonate by volume. Even at relatively low levels of zinc antimonate in the conductive layer, as in the conductive layers of Example 13 containing nominally 12% by volume zinc antimonate (22% by weight), SER values of 10.4 and 10.5 log ohms/square are obtained for total dry coverages of 1 $g/m^2$ and 0.6 $g/m^2$. However, at slightly lower volume percentages of zinc antimonate, as in the case of the layer of Comparative Example 10 containing only 7% zinc antimonate by volume (30% by weight), the amount of conductive particles is insufficient to form an effective conductive network and thus, the layer is not conductive. Further, the contribution of the metal-containing filler particles to the electrical conductivity of the conductive layers of this invention is insignificant relative to the metal antimonate particles as demonstrated by the SER of the conductive layer of Comparative Example 8 containing 52% synthetic clay filler by volume (70% by weight). Thus, the above results demonstrate that the level of conductivity of the conductive layers of this invention primarily depends on the volume fraction of zinc antimonate particles present in the layer rather than the weight fraction of zinc antimonate for layers coated at constant total dry weight coverages.

Because less zinc antimonate is present in the conductive layers of this invention as described hereinabove, the optical density and haze is substantially less for these layers than for conductive layers exhibiting comparable SER values coated at the same total dry coverages, but containing unsubstituted zinc antimonate particles. For example, the conductive layers of Examples 8a, 14a, 15a, and 12a all containing 21% zinc antimonate by volume (55, 56, 52, 43.5% by weight) with SER values of 8.3, 8.5, 8.7, and 9.1 log ohms/square respectively, have ΔUV $D_{min}$ and ΔOrtho $D_{min}$ values which are substantially lower than those for the conductive layer of Comparative Example 12a which also contains 21% zinc antimonate by volume (60% by weight) and has a SER value of 8.5 log ohms/square. However, the ΔUV $D_{min}$ and ΔOrtho $D_{min}$ values of the layers of Examples 8a, 14a, and 15a are much closer to those of the layer of Comparative Example 9a containing only 15% zinc antimonate by volume (50% by weight) with a higher SER value of 9.1 log ohms/square. Further, the conductive layer of Example 12a which contains 21% zinc antimonate by volume (33% by weight) with a SER value of 9.1 log ohms/square exhibits ΔUV $D_{min}$ and ΔOrtho $D_{min}$ values which are nearly identical to those of the layer of Comparative Example 10 containing 30% zinc antimonate by weight (7% by volume) which is non-conductive. Although the SER values for the conductive layers of Examples 10a and 16a which contain 13% zinc antimonate by volume (40% and 41.5% by weight) are comparable to that of Comparative Example 10a, the ΔUV $D_{min}$ and ΔOrtho $D_{min}$ values are closer to those of the non-conductive layer of Comparative Example 10. Similarly, the conductive layer of Example 13a containing only 12% zinc antimonate by volume (22% by weight) with an SER value of 10.4 log ohms/square has ΔUV $D_{min}$ and ΔOrtho $D_{min}$ values which are nearly identical to those for the non-conductive layer of Comparative Example 10. Thus, the above results clearly demonstrate that the net UV and optical densities for the conductive layers of this invention depend mainly on the weight fraction of metal antimonate particles in the layer rather than volume fraction of metal antimonate for layers coated at constant total dry weight coverage. Furthermore, there appears to be little or no dependence on the type of non-conductive metal oxide filler particle used (e.g., synthetic clay, colloidal tin oxide or colloidal silica) with a polyurethane binder.

The results presented hereinabove demonstrate that the conductive layers of this invention containing conductive zinc antimonate particles partially substituted by colloidal, non-conductive metal-containing filler particles exhibit improved surface conductivities at substantially lower weight fractions and/or dry weight coverages of zinc antimonate and also exhibit consequently, improved net optical and UV densities relative to conductive zinc antimonate conductive layers of prior art.

The invention has been described in detail with particular reference to certain preferred embodiments thereof, but it will be understood that variations and modifications can be effected within the spirit and scope of the invention.

What is claimed is:

1. A multilayer imaging element comprising:

a support;

at least one image-forming layer; and a transparent electrically-conductive layer comprising electronically-conductive metal antimonate colloidal particles having a particle size of from 0.005 to 0.05 μm and non-conductive metal-containing colloidal particles having a particle size of from 0.002 to 0.05 μm dispersed in a film-forming binder.

2. The imaging element of claim 1, wherein the conductive metal antimonate particles comprise a volume percentage of from about 10 to 75% of the volume of said electrically-conductive layer.

3. The imaging element of claim 1, wherein the non-conductive metal-containing particles comprise a volume percentage of from 2 to 45% of the volume of said electrically-conductive layer.

4. The imaging element of claim 1, wherein the binder comprises a volume percentage of from 20 to 88% of the volume of said electrically-conductive layer.

5. The imaging element of claim 1, wherein the electrically conductive layer has a total dry weight coverage of from about 0.1 to about 10 g/m$^2$.

6. The imaging element of claim 1, wherein the average primary particle size of the electronically-conductive metal antimonate colloidal particles is from 0.015 μm to 0.03 μm.

7. The imaging element of claim 1, wherein the metal antimonate colloidal particles comprise:

$$M^{+2}Sb^{+5}{}_2O_6$$

wherein $M^{+2}$ is $Zn^{+2}$, $Ni^{+2}$, $Mg^{+2}$, $Fe^{+2}$, $Cu^{+2}$, $Mn^{+2}$, or $Co^{+2}$.

8. The imaging element of claim 1, wherein the metal antimonate colloidal particles comprise:

$$M^{+3}Sb^{+5}O_4$$

wherein $M^{+3}$ is $In^{+3}$, $Al^{+3}$, $Sc^{+3}$, $Cr^{+3}$, $Fe^{+3}$ or $Ga^{+3}$.

9. The imaging element of claim 1, wherein the metal antimonate colloidal particles comprise $ZnSb_2O_6$.

10. The imaging element of claim 1, wherein the metal antimonate colloidal particles comprise $InSbO_4$.

11. The imaging element of claim 1, wherein the non-conductive metal-containing colloidal particles comprise a metal oxide selected from the group consisting of tin oxide, zinc oxide, antimony pentoxide, germanium dioxide, titania, zirconia, alumina, silica, alumina-modified silica, magnesia and zinc antimonate.

12. The imaging element of claim 1, wherein said non-conductive metal-containing colloidal particles comprise clay.

13. The imaging element of claim 12, wherein the clay is selected from the group consisting of kaolin, bentonite, montmorillonite, beiderite, hectorite and saponite.

14. The imaging element of claim 1, wherein the film-forming binder comprises a water-soluble, hydrophilic polymer.

15. The imaging element of claim 1, wherein the film-forming binder is selected from the group consisting of gelatin, cellulose derivative, organic solvent-soluble polymer and water-dispersible, water-insoluble polymers.

16. The imaging element of claim 1, wherein said support is selected from the group consisting of poly(ethylene terephthalate) films, poly(ethylene naphthalate) films, cellulose acetate films, papers, and polymer coated papers.

17. A photographic film comprising:

a support;

an electrically-conductive layer superposed on said support; and;

a silver halide emulsion layer superposed on said electrically-conductive layer; wherein said electrically-conductive layer comprises electronically-conductive metal antimonate colloidal particles having a particle size of from 0.005 to 0.05 μm and non-conductive metal-containing colloidal particles having a particle size of from 0.002 to 0.05 μm dispersed in a film-forming binder.

18. A photographic film comprising:

a support;

a silver halide emulsion layer superposed on a first side of said support; and an electrically-conductive layer superposed on a second side of said support; said electrically-conductive layer comprising electronically-conductive metal antimonate colloidal particles having a particle size of from 0.005 to 0.05 μm and non-conductive metal-containing colloidal particles having a particle size of from 0.002 to 0.05 μm dispersed in a film-forming binder.

19. A photographic film comprising:

a support;

a silver halide emulsion layer superposed on a first side of said support;

an electrically-conductive layer superposed on a second side of said support; and an abrasion-resistant backing layer overlying said electrically-conductive layer; wherein said electrically-conductive layer comprises electronically-conductive metal antimonate colloidal particles having a particle size of from 0.005 to 0.05 μm and non-conductive metal-containing colloidal particles having a particle size of from 0.002 to 0.05 μm dispersed in a film-forming binder.

20. A photographic film comprising:

a support;

a silver halide emulsion layer superposed on a first side of said support;

a multi element curl control layer superposed on a second side of said support comprising;

a pelloid layer;

an electrically-conductive layer superposed on the pelloid layer; and an overcoat layer overlying said electrically-conductive layer; wherein said electrically-conductive layer comprises electronically-conductive metal antimonate colloidal particles having a particle size of from 0.005 to 0.05 μm and non-conductive metal-containing colloidal particles having a particle size of from 0.002 to 0.05 μm dispersed in a film-forming binder.

21. A thermally-processable imaging element comprising:

a support;

an electrically-conductive layer superposed on said support; and;

a thermographic imaging layer overlying said electrically-conductive layer; said electrically-conductive layer comprising electronically-conductive metal antimonate colloidal particles having a particle size of from 0.005 to 0.05 μm and non-conductive metal-containing colloidal particles having a particle size of from 0.002 to 0.05 μm dispersed in a film-forming binder.

22. A thermally-processable imaging element comprising:

a support;

a thermographic imaging layer superposed on a first side of said support; and an electrically-conductive protective layer overlying said imaging layer; said electrically-conductive layer comprising electronically-conductive metal antimonate colloidal particles having a particle size of from 0.005 to 0.05 μm and non-conductive metal-containing colloidal particles having a particle size of from 0.002 to 0.05 μm dispersed in a film-forming binder.

23. A thermally-processable imaging element comprising:

a support;

a thermographic imaging layer on one side of said support; and an electrically-conductive backing layer superposed on a second side of said support; said electrically-conductive layer electronically-conductive metal antimonate colloidal particles having a particle size of from 0.005 to 0.05 μm and non-conductive metal-containing colloidal particles having a particle size of from 0.002 to 0.05 μm dispersed in a film-forming binder.

24. A thermally-processable imaging element comprising:

a support;

a thermographic imaging layer on a first side of said support; and a multi element curl control layer superposed on a second side of said support comprising;

a pelloid layer;

an electrically-conductive layer superposed on the peloid layer; and an overcoat layer superposed on a second side of said support; said electrically-conductive layer electronically-conductive metal antimonate colloidal particles having a particle size of from 0.005 to 0.05 μm and non-conductive metal-containing colloidal particles having a particle size of from 0.002 to 0.05 μm dispersed in a film-forming binder.

* * * * *